US005164782A

United States Patent [19]

Nagayama et al.

[11] Patent Number: 5,164,782

[45] Date of Patent: Nov. 17, 1992

[54] ELECTROPHOTOGRAPHIC COPYING APPARATUS

[75] Inventors: Katsuhiro Nagayama, Yamato-Koriyama; Yasutaka Maeda, Itoma; Hideyuki Nishimura, Yamato-Koriyama; Yoichi Shimazawa, Nara; Koichi Moriyama, Yamato-Koriyama; Hideo Matsuda, Nara, all of Japan

[73] Assignee: Sharp Kabushiki Kaisha, Osaka, Japan

[21] Appl. No.: 774,197

[22] Filed: Oct. 10, 1991

[30] Foreign Application Priority Data

Oct. 15, 1990 [JP] Japan ..... 2-275955
Oct. 16, 1990 [JP] Japan ..... 2-278717

[51] Int. Cl.[5] ..... G03G 15/20

[52] U.S. Cl. ..... 355/285; 355/289; 355/290; 355/295; 430/124

[58] Field of Search ..... 355/285, 289, 290, 295, 355/203, 208, 282, 283, 326, 327; 219/216; 430/97-99, 124, 126

[56] References Cited

U.S. PATENT DOCUMENTS 4,253,008 2/1981 Dolan ..... 219/216 X
5,051,784 9/1981 Yamamoto et al. ..... 355/285

FOREIGN PATENT DOCUMENTS 59-22226 5/1984 Japan .
0019376 1/1989 Japan ..... 355/285
272376 3/1990 Japan .
2162383 6/1990 Japan .

*Primary Examiner*—A. T. Grimley
*Assistant Examiner*—Matthew S. Smith

[57] ABSTRACT

An electrophotographic copying apparatus comprises a photosensitive member (4) exposed by light reflected from an original to form an image of the original thereon, mechanism (13) for developing the image on the photosensitive member with toner (9, 10, 11, 12) to produce a toner image corresponding the image mechanism (24) for transferring the toner image onto a transfer material, mechanism (26) for fixing the toner image transferred on the transfer material, mechanism (27) for producing a signal which represents that high surface glossiness of the image copy is required, and mechanism (31, 32) for feeding the transfer material in a first path when the signal is produced, the transfer material being fixed fully, and for feeding the transfer material in a second path shorter than the first path when the signal is not produced.

13 Claims, 5 Drawing Sheets

ELECTROPHOTOGRAPHIC COPYING APPARATUS

BACKGROUND OF THE INVENTION

1. Field of the Invention

The present invention relates to an electrophotographic copying apparatus, particularly to a color electrophotograhic copying apparatus.

2. Description of the Related Art

There is conflicting demand for the surface glossiness between a color image copy and a black and white image copy on a transfer paper. Color copying requires high glossiness for color reproduction while black and white reproduction needs none of such a property which may rather impair legibility and other characteristics reproduced.

It is known that the glossiness of a image copy depends upon a fixing process and is associated with toner melting in particular. In general, a fixing device is so constructed as to soften or melt toner resin by heating or by using a solvent, allowing it to permeate into the tissue of a transfer paper so that the toner is fixed on the paper to give a glossy image copy. Such the fixing device may be provided with a heat roller in order to heat the toner. In this type of color copier, the two- or three-color toners on the transfer paper are melt and mixed through the heat roller.

In color copying, if the toner image is melted insufficiently, it must involve layer interfaces (cavities) which scatter incident light. As a result the image copy have no reproducibility of the original. Similarly, unless the toner transferred onto the transfer paper has a mirror surface, the incident light is reflected by diffusion on the toner surface and hardly admitted to enter the toner layer, making the colors on the transfer paper dark and cloudy.

Therefore toner with a low melting point is used to give glossy and vivid colors. Thereby no interfaces are expected to be formed within the layer of the toner image because of complete toner melting. The toner may be completely melted and becomes less viscous enough to give a hardened flat surface when the transfer paper is sent out of the heat rollers.

However, it is known that there occurs the separation of toner in its layer called an offset phenomenon when the transfer paper is fed out of the heat rollers. The offset phenomenon is also explained below along with the method of solving it, using illustrated figures.

FIG. 1*a* is a view illustrating how the bonding strength is exerted on a transfer paper 70, a heat roller 71, and toner layer 72. FIG. 1*b* illustrates a view showing the bonding strengths exerted on the transfer paper 70, the heat roller 71, toner layer 72, and oil layer 73.

As shown in FIG. 1*a*, the utilization of above-mentioned toner with a low melding point raises a problem of an offset phenomenon occurring because the bonding strength $F_T$ within the toner layer 72 is smaller than the bonding strength $F_R$ exerted between the toner layer 72 and the heat roller 71 as well as the bonding strength $F_P$ between the toner layer 72 and the transfer paper 70 ($F_T<F_R$, $F_p$).

To prevent the occurrence of the offset phenomenon, a recent electrophotographic copying apparatus capable of color copying is so constituted that application of oil on the surface of the heat roller 71 in large quantities, as shown in FIG. 1*b*, established a relationship represented as the following equation (1) among the bonding strengths $F_1$ within the oil layer 73, $F_2$ exerted between the oil layer 73 and toner layer 72 $F_{R'}$ between the oil layer 73 and heat roller 71, $F_T$ within the toner layer 72, and $F_P$ between the toner layer 72 and transfer paper 70:

$$F_1 << F_2 = F_{R'} < F_T < F_P \quad (1)$$

In other words, the occurrence of an offset phenomenon is prevented by the presence of an oil layer which makes the bonding strength $F_{R'}$ exerted between the oil layer 72 and the heat roller 71 smaller than $F_R$ as shown in FIG. 1*a*.

However there is given such a problem that the difficulty in constantly supplying a uniform layer of oil with low viscosity, namely, small bonding strength $F_1$ within its layer 73. The reasons are why that oil flows; surface energy of the heat roller must be raised to constantly supply a uniform layer of oil; supply of oil necessitates a tank for storage and a roller and blade for application of oil; and oil tends to vaporize when heated, giving adverse effects to other processes.

As a method of solving such a problem, U.S. Pat. No. 3,578,797 is disclosed. According to the patent, a toner image is fixed by allowing it to contact a heating web to be heated and melted, cooling the melted toner to make it relatively highly viscous, and removing the transfer paper from the heating web when the toner thus no longer adheres to the web strongly. It is, however, known that it takes the toner a long time to be heated and melted if not allowed to contact the heating body under pressure because the heat transfers very slowly.

In the Japanese Patent Publication No. 72376 (1990) and No. 162383 (1990), a method of pressurized toner heating is disclosed. The transfer paper is heated and pressurized between a heating and a pressure roller, then conveyed while being allowed to tightly contact a fixing film, and removed from the film after cooled below the melting point of the toner. The fixing film is supported by the heating or pressure roller and other rollers and controlled so as to move at an equal speed. This permits the surface glossiness of a toner image to be established as desired in accordance with the surface coarseness of the fixing film as the sufficiently heated toner image surface is kept contacting the fixing film until it is cooled to solidify.

Notwithstanding, a problem common to such the mechanism to improve glossiness in color copying is that improved glossiness rather cause a disadvantage to black and white reproduction as mentioned above.

In other words, on one hand utilization of toner with a low melting point gives a highly glossy and vivid reproduction if an offset phenomenon is prevented, on the other hand a high glossiness causes the image copy including letters and figures indistinct due to the reflected light in black and white copying if the copier operates under the same conditions.

SUMMARY OF THE INVENTION

It is therefore an object of the present invention to provide an electrophotographic copying apparatus capable of reproducing the desirable glossiness of an original and obtaining vivid color image copy without causing an offset phenomenon.

An electrophotographic copying apparatus according to the present invention comprises a photosensitive member exposed by light reflected from an original to form an image of the original thereon, mechanism for developing the image of said original with toner to produce a toner image corresponding to the image, mechanism for transferring the toner image onto a transfer material, mechanism for fixing the toner image transferred on the transfer material, mechanism for producing a signal which represents that surface glossiness of said image copy is required, mechanism for feeding said transfer material in a first path when the signal is produced and for feeding said transfer material in a second path shorter than said first path when the signal is not produced.

Thereby high glossiness is obtained in copying a color original and low glossiness is obtained in copying a black and white original because the fixing time of the toner image is different depending on whether the original is colored or not.

Preferably the fixing mechanism include a film member on which the surface of the toner image on the transfer material abuts and a heat source for heating the toner image to be melt disposed adjacent to the film member. The fixing mechanism may include a heat roller for driving rotationally the film member. The heat source is contained in the heat roller.

In a preferred embodiment the feeding mechanism include a first roller at a certain distance from the heat roller and a second roller disposed between the heat roller and the first roller in the way of the film member conveying from the heat roller in the loop of the film member, and the film member is stretched between the heat roller and the first roller and is driven to rotate by the heat roller. The transfer material is separated from the film member at a position where the first roller is disposed when high surface glossiness of the image copy is required or at a position where the second roller is disposed when low surface glossiness of the image copy is required.

The apparatus may include mechanism for shifting a position of the first roller toward a vertical direction against the plane surface of the film member so that the film member is bent at the second roller.

In operation, a charged image is formed on the photosensitive member from an original by the exposing mechanism and a toner image is formed by the developing mechanism. The material onto which the transferred image is transferred is heated to be melted by a heat source as a fixing mechanism, and the image section on the transfer material is allowed to adhere to the film member and then, after cooled, removed from the film by a feeding mechanism. Occurrence of an offset phenomenon can, therefore, not only be prevented but also a glossy and vivid full-color copy can be obtained by using toner with a low melting temperature even if no oil is applied on the surface of the first roller.

The transfer material is separated from the film member at a position where the first roller is disposed when high surface glossiness of the image copy is required. The position of the first roller is shifted toward a vertical direction against feeding direction of the transfer material so that the film member is bent at the second roller when low surface glossiness of the image copy is required. Then the transfer material is separated from the film member at the position of the second roller on a situation that the toner image on the transfer material is not cooled fully.

Therefore, reproduction with a different level of glossiness is quite practicable, that is, a highly glossy product can be obtained from full-color copying while a less glossy one from black and white operation by means of the fixing mechanism and the separating mechanism.

Further objects and advantages of the present invention will be apparent from the following description of the preferred embodiments of the invention as illustrated in the accompanying drawings.

DESCRIPTION OF THE PREFERRED EMBODIMENTS

Preferred embodiments of the present invention relating to an electrophotographic copying apparatus are described in detail below, using attached drawings.

Figure 1A:
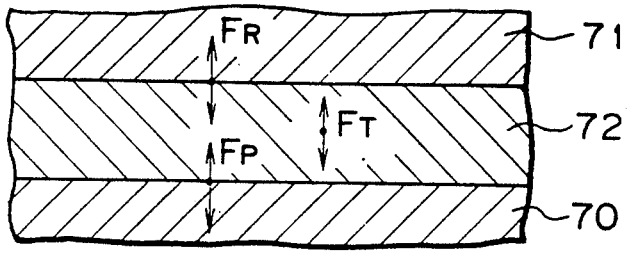
FIG. 1*a* is a drawing illustrating the profile of bonding strengths exerted on the toner layer, heat roller, and transfer paper.
Figure 1B:
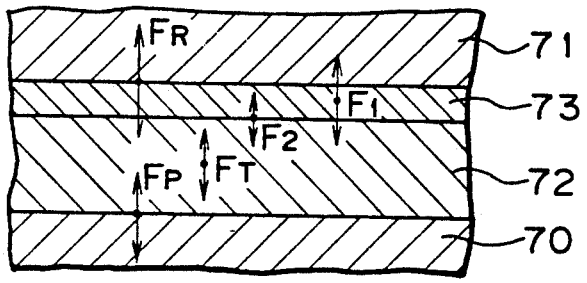
FIG. 1*b* is a drawing illustrating the profile of bonding strengths exerted on the toner layer, heat roller, transfer paper, and oil layer.
Figure 2:
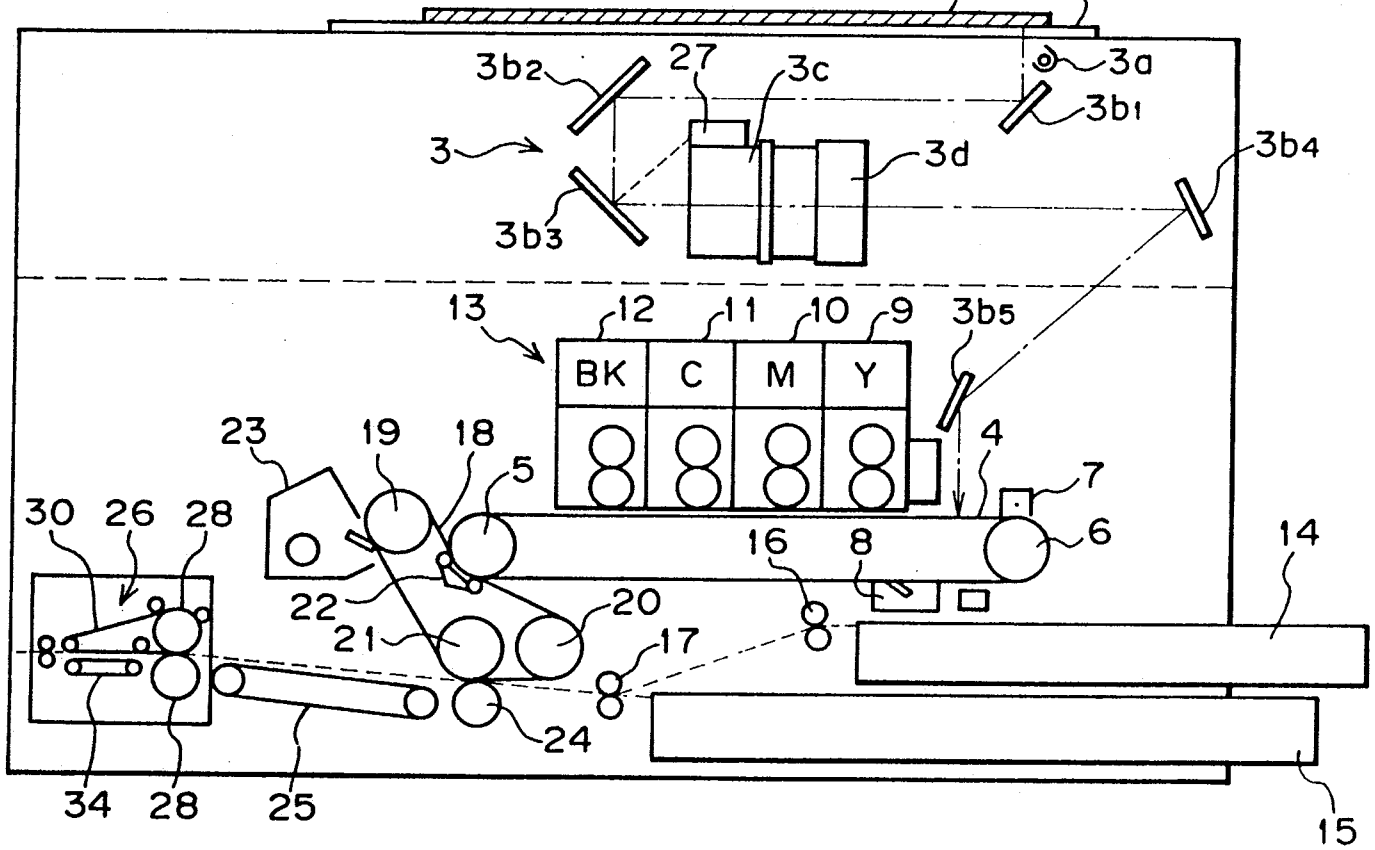
FIG. 2 shows a sectional view of an electrophotographic copying apparatus according to a preferred embodiment of the present invention.

FIG. 2 shows the construction of an electrophotographic copying apparatus according to a first embodiment of the present invention.

As shown in FIG. 2, below a transparent original mounting platform 1 disposed on the top of the apparatus, an optical system 3 for exposure is arranged to expose a photosensitive body 4 to the light by optically scanning the original 2. The optical system 3 for exposure is provided with a light-source lamp 3*a* which irradiates the original 2, the first through fifth mirrors $3b_1$–$3b_5$ which send by reflecting the light reflected from the original 2 onto the photosensitive body 4, e.g., as shown by a pointed chain line in FIG. 2, an image-forming lens 3*c* arranged along the passage of the reflected light, and color spectrographic filters 3*d* including red, green, and blue three-primary-color filter. Near the image-forming lens 3*c* in the optical system 3 for exposure, a CCD (charge coupled device) sensor 27 is arranged as an original color detecting means to detect the color of the original by sensing the light reflected from the third mirror $3b_2$.

Below the optical system 3 for exposure , a photosensitive body 4 is provided in the form of a belt. The photosensitive body 4 is stretched between the two rollers 5 and 6 arranged at a certain distance from each other so as to be driven to rotate. Around the roller 6 for the photosensitive body 4 there is provided with an electrifier 7 which charges the photosensitive body 4 with electricity and a cleaning device 8 which removes residual toner on the photosensitive body 4.

On the upper side of the photosensitive body 4, a developing device 13 with four developer containers 9–12 is so disposed as not to contact the photosensitive body 4. In the developing device 13, the developer containers 9–11 separately contain yellow, magenta, and cyan toners. Each of the color toners is complementary to the color of each of spectrographic filters 3*d*. In addition the developer container 12 stores black toner. Each of the toners is made mainly of thermoplastic resin.

Below the photosensitive body 4 are arranged cassette feeders 14 and 15 with carriage rollers 16 and 17 respectively disposed in the feeding direction. On the side of the roller 5 for the photosensitive body 4, a intermediary transfer member 18 is provided in the form of a belt driven by the three rollers 19–21. Around the intermediary transfer member 18 there is provided with a transfer roller 22 which transfers a toner image on the photosensitive body 4 onto the intermediary transfer member 18, a cleaning device 23, and a transfer roller 24 which transfers the toner image on the intermediary transfer member 18 onto the transfer paper. In the direction for the paper fed out of the intermediary transfer member 18, there is provided with a conveyance belt 25 and a fixing device 26 which fixes the toner transferred onto the paper by heating the transfer paper.

Figure 3:
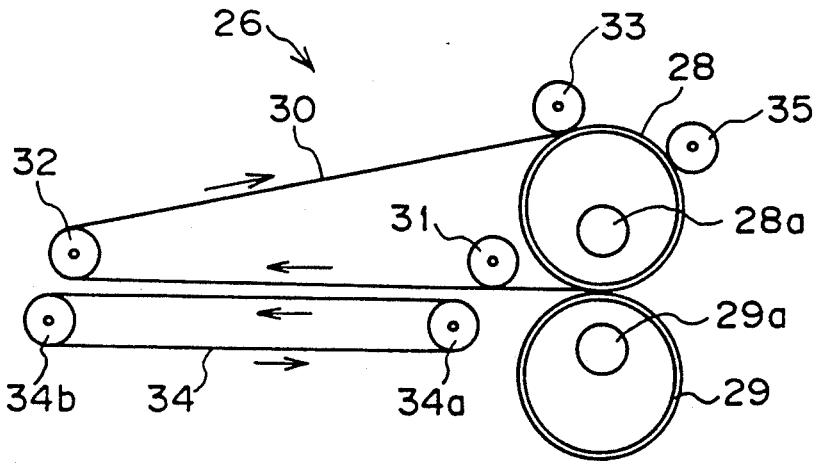
FIG. 3 shows a sectional view of a typical fixing device.

FIG. 3 illustrates in detail a fixing device 26 according to the first preferred embodiment.

As shown in FIG. 3, a fixing device is provided with an upper heat roller 28 containing a heater lamp 28*a*, a lower heat roller 29 containing a heater lamp 29*a*, a fixing film 30 driven in the form of a belt, small-size film -feeding rollers 31–33 as movable to support the film, a suction belt 34 driven by rollers 34*a* and 34*b* to feed the transfer paper, and a cleaning roller 35 functioning as a cleaning device.

The film-feeding roller 32 is disposed at a certain distance from the upper heat roller 28 and the film 30 is stretched between them. The film-feeding roller 31 is provided between the film-feeding roller 32 and the upper heat roller 28 so as to be located nearer to the latter in the loop of the film 30, and the film-feeding roller 33, diagonally above the upper heat roller 28 outside of the loop of the film 30. The fixing film 30, supported by the upper heat roller 28 and the film-feeding roller 32, is driven by the film feeding rollers 31–33 and the upper heat roller 28 to move face to face with the suction belt 34. The film-feeding roller 32 is so designed that, driven by an undermentioned roller driver 36, it is shifted upward from the position illustrated in FIG. 3 to that shown in FIG. 4. In consequence, the section between the film-feeding rollers 31 and 33 moves from the color-copying position close to the opposing suction belt 34 as indicated in FIG. 3 to the FIG. 4 black and white-reproduction position apart from the suction belt 34. The cleaning roller 35, allowing the fixing film 30 to contact-slide on it at a point along the outer circumference of the upper heat roller 28, removes residual toner on the fixing film 30.

Figure 5:
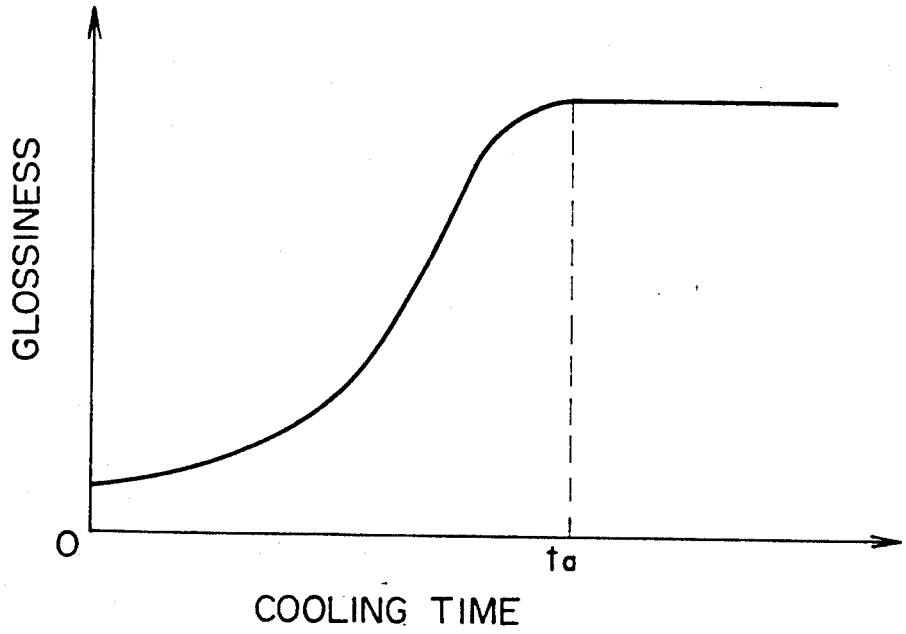
FIG. 5 is a curve showing the relation between the cooling time of the fixing device shown in FIG. 3 and glossiness.

Here, the curve in FIG. 5 indicates the relation between the cooling time, i.e., the time from heating by the upper and lower heat rollers 28 and 29 to removal of the transfer paper from the fixing film 30 and the glossiness of an image obtained by fixing operation. The toner layer, on the transfer paper, melted when heated by the upper and lower heat rollers 28 and 29 is cooled to solidify while being fed with the fixing film arranged to contact the toner surface. Consequently, if the fixing film is removed after the toner layer is cooled to solidify, that is, after cooled for a long time, the surface of the toner layer becomes flat enough to reflect less light by diffusion, giving a highly glossy image as indicated in the same figure. On the other hand, if the fixing film is removed while the toner layer remains unsolidified, that is, if the cooling time is short, the toner is separated at the hard-to-solidify middle part inside the layer into a portion attached to the transfer paper and the other portion adhering to the fixing film 30. The surface of the toner layer on the transfer paper, therefore, becomes coarse and reflects more light by diffusion to reproduce a less glossy image. A better image can thus be obtained in both color and black and white reproduction by setting the cooling time, e.g., at Ta capable of reproducing high glossiness when the fixing film 30 is in the color-copying position and at appropriately lower than Ta when the fixing film 30 is in the black and white-reproduction position.

Figure 6:
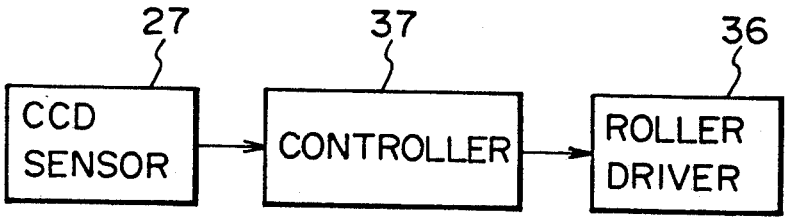
FIG. 6 is a block diagram of a device controlling the drive of the fixing device roller shown in FIG. 3.

Preferably, a fixing device 26, provided with a roller driver 36 and a control device 37 as shown in FIG. 6, is so constructed that the fixing film 30 is caused to move between the color- and the black and white-reproduction position in accordance with a output signal from a CCD sensor. Specifically, the control device 37 is designed to control the roller driver 36 so that the fixing film 30 is arranged to take the color-copying position when the CCD sensor 27 senses the color original but is assigned to the black and white-reproduction position if the original is identified as a black and white one. At the same time, the control device 37 controls other devices which select suitable operations for color-copying or black and white-reproduction operation according to the judgement on the original by the output signal of the CCD sensor 27.

If the copy start buttons is pressed, the original 2 is first scanned by the light-source lamp 3*a* in the optical system 3 for exposure, the reflected light is guided by the first through third mirrors $3b_1$–$3b_3$ into the CCD sensor 27. The control device 37 receives the RGB signal corresponding with the color of the original from the CCD sensor 27 and judges whether the original is a colored or black and white one. If the original is colored, not only each mechanism is controlled to select operations suitable for color-copying but also the roller driver 36 is controlled so that the fixing film 30 in the fixing device 26 is arranged to take the color-copying position as shown in FIG. 3. On the other hand, if the original is a black and white one, each mechanism is similarly controlled to select operations suitable for black and white-reproduction and, at the same time, the roller driver 36 is controlled so that the fixing film 30 is assigned to the black and white-reproduction position as shown in FIG. 2.

The operation of a full-color copier for a color original is described below with reference to FIG. 2.

First, the light-source lamp 3*a* scans by irradiation the original 2 mounted on the original mounting platform 1 three times. The light reflected from the original 2 is sent by way of the first through third mirrors $3b_1$–$3b_3$ and the image-forming lens 3*c* to enter the color spectrographic filters 3*d*, where the light is separated into each color component. The light is further guided by the fourth and fifth mirrors $3b_4$ and $3b_5$ and applied onto the photosensitive body 4 uniformly charged by the electrifier 7 so that the photosensitive body 4 is exposed to the said light. This forms on the photosensitive body 4 three electrostatic latent images corresponding with the image of the original 2.

Each of the electrostatic latent images is developed into a visualized toner image by the developing device 13 with each toner of yellow, magenta, and cyan complementary to the color of each filter composing the color spectrographic filters 3*d*. These by-color component toner images are in turn transferred onto the intermediary transfer member 18 by the transfer roller 22 to superposed to form a color toner image. The color toner image is transferred by the transfer roller 24 onto the transfer paper fed from the cassette feeder 14 or 15 and then introduced into the fixing device 26 by the conveyor belt 25.

The transfer paper introduced into the fixing device is heated by the upper and lower heat rollers 28 and 29 so that the toner on the transfer paper is melted. The transfer paper which passed through the upper and lower heat rollers 28 and 29 is carried by the suction belt 34 with the upper surface of the toner layer arranged to contact the fixing film 30. In copying the color original the fixing film 30 is in the color-copying position as shown in FIG. 3, and thereby fixing film 30 are cooled certainly during the carriage operation, allowing the toner layer to solidify while being flattened by the fixing film 30. After that, the fixing film is removed from the surface of the toner layer when the transfer paper reaches the film-feeding roller 32. The resulting color image is a highly glossy or excellently reproduced one with less light reflected by diffusion on the surface of the toner layer.

Next, the operation of a full-color copier when used for black and white reproduction is described below.

When the original to be copied is a black and white one, the original 2 is, as shown in FIG. 2, subject to single scanning at the optical system 3 for exposure and the resulting light reflected from the original 2 is irradiated onto the photosensitive body 4 without being passed through the color spectographic filters 3*d* so that the photosensitive body is exposed to the light. The electrostatic latent image thus formed is developed into a visualized toner image by black toner in the developer container 12. The toner image is transferred onto the transfer paper by way of the intermediary transfer member 18 and the transfer paper is further introduced into the fixing device 26.

Figure 4:
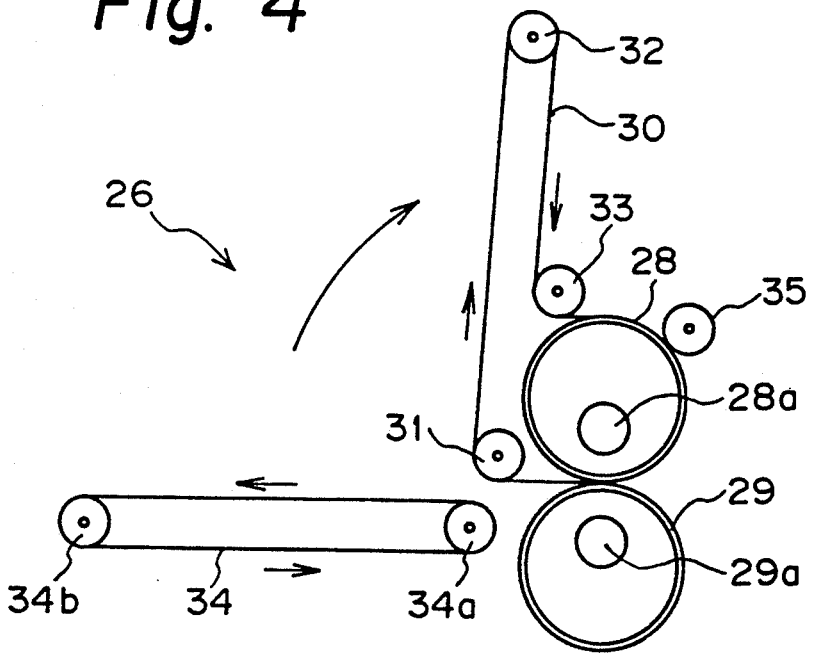
FIG. 4 shows a sectional view of the fixing device shown in FIG. 3 when used in black and white copying.

After that, the transfer paper introduced into the fixing device 26 is, as indicated in FIG. 4, heated by the upper and lower heat rollers 28 and 29 so that the toner on the transfer paper is melted. The transfer paper is further conveyed out from the upper and lower heat rollers 28 and 29 toward the upper side of the suction belt 34 with the upper surface of the melted toner layer arranged to contact the fixing film 30. In copying the black and white original, the melted toner is cooled to be removed from the fixing film 30 in a short time, that is, the toner is removed from the fixing film 30 while the toner remains solidified insufficiently. Consequently, the toner layer is in the state of being separated around its insufficiently-hardened middle part to be partially attached to the fixing film 30. This gives a coarse surface of the toner layer on the transfer paper, producing a less glossy image. On the other hand, the toner attached to the fixing film 30 is melted once again by the heat roller and removed from the fixing film 30 by the cleaning roller 35. In this way, in black and white reproduction, a good-quality image which is less glossy and quite legible can be obtained.

Another preferred embodiment of the present invention is described below, using FIG. 7.

A fixing device is provided with heat rollers 40 and 41 each containing a halogen lamp, a heat-resistant endless film 42, a cooling fan 43, a tension spring 44, a roller 45, a cleaning roller 46 for cleaning the surface of heat-resistant endless film 42, and a feeding guide 47 for guiding the transfer paper.

Other parts of the copier except the fixing device 26 are the same as shown in FIG. 2.

Figure 7:
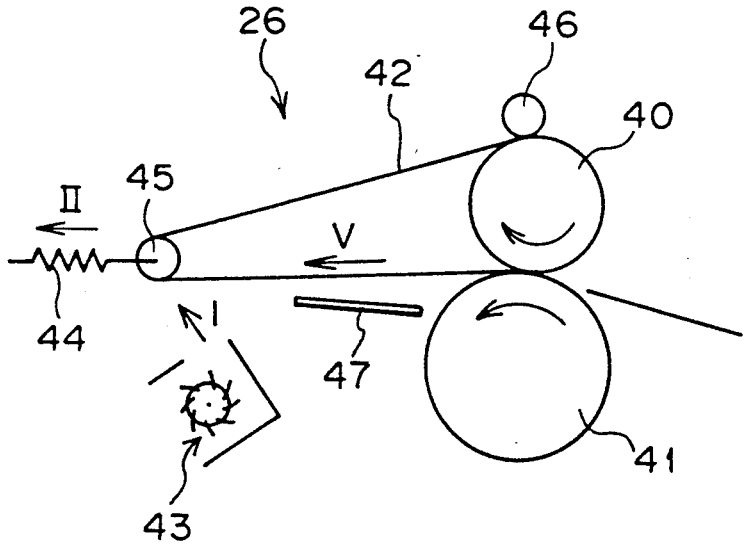
FIG. 7 shows a sectional view of a fixing device according to another preferred embodiment.

The heat roller is so designed as to drive the heat-resistant endless film 42 into rotary motion in the clockwise direction as shown in the figure at a speed of v as shown in FIG. 7.

The heat-resistant endless film 42 is so formed as to have surface energy of 30 dyne/cm or less and stretched between the heat roller 40 and the roller 45.

The heat roller 40 and the roller 45 are, as mentioned later, placed apart enough for the image section, or the toner image transferred onto the transfer paper, to be removed from the heat-resistant endless film 42 at the roller 45 position.

The cooling fan 43 is disposed in a manner which allows it to blow air against the lower portion of the roller 45 (in the direction of I in the figure).

The roller 45 is so configured as to be urged by the tension spring 44 in the direction of increasing the distance from the heat rollers 40 and 41 (in the direction of II in the figure).

The transfer paper having a color toner image is conveyed between the heat rollers 40 and 41, during which the color toner image transferred from the original is heated by the heat rollers 40 and 41 so that the toner image of the transfer paper is welded onto the heat-resistant endless film 42, carried along the guide 47, and then getting out from the heat-resistant endless film 42 at the roller 45 position after the toner section of the transfer paper is removed.

When sent out, the transfer paper can be cooled by the wind blown from the cooling fan 43 at the roller 45 position.

The color toners are usually made of polyester, epoxy, or other resin with a relatively low melting temperature (around 120°-95° C.), and the amount of the toners attached onto the paper is some 3 mg/cm$^2$ at most.

Using the toner thus prepared and the heat-resistant endless film 36 made of heat-resistant polyimide resin and coated with fluorite resin with a surface energy of 25 dyne/cm under the conditions of the heat-resistant endless film 36 rotation speed v being 170-100 mm/sec and the fixing temperature being 190°-170° C., an electrophotographic copying apparatus of the above-mentioned construction was tested experimentally, resulting in a very glossy and vivid full-color reproduction.

Specifically, the glossmeter reading indicates the surface glossiness of 40-60% substantially improved from 20-30% obtained in full-color copying under the same conditions as above except for a large quantity of oil applied on the surface of the heat roller 40.

Using toner with a low melting temperature, therefore, a glossy and vivid copy can be obtained while protecting the occurrence of an offset phenomenon even if no oil is applied on the surface of the heat roller.

In addition, air cooling by the cooling fan 43 brings more effective removal of the transfer paper from the heat-resistant endless film 42.

The heat-resistant endless film 42 may be made of polyether sulfonic acid or other resin instead of heat-resistant polyimide and the surface of the heat-resistant resin may be coated with silicone or other resin.

Figure 8:
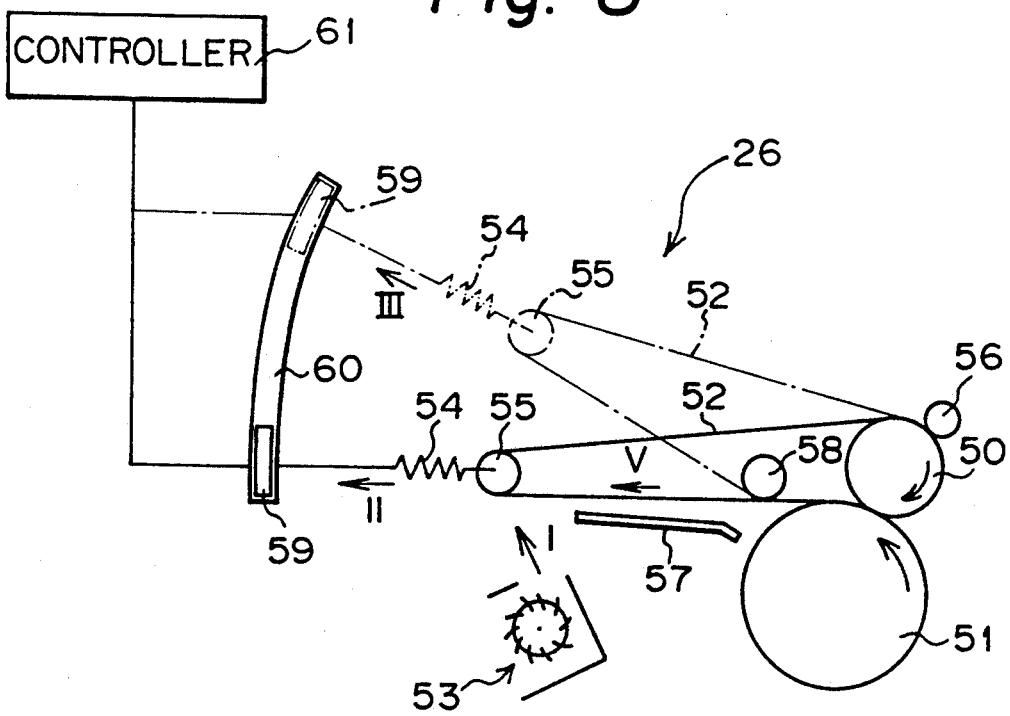
FIG. 8 shows a sectional view of a fixing device according to the remaining preferred embodiment.

In a preferred embodiment, a fixing device is, as shown in FIG. 8, provided with heat rollers 50 and 51 each containing a halogen lamp, a heat-resistant endless film 52, a cooling fan 53, a tension spring 54, a roller 55 connected to one end of the tension spring 54, a cleaning roller 56 for cleaning the surface of heat-resistant endless film 52, a paper feeding guide 57, a roller 58, a movable member 59 connected to the other end of the tension spring 54, a guide 60 along which the member carts 59 can move, and a controller 61 which controls the position of the movable member 59.

The heat roller 50 is so designed as to drive the heat-resistant endless film 52 into rotary motion in the clockwise direction, as shown in FIG. 8, at a speed of v.

The heat-resistant endless film 52 is so formed as to have a surface energy of 30 dyne/cm or less, and stretched between the heat roller 50 and the roller 55.

The heat rollers 50 and the roller 55 are, as mentioned later, placed apart enough for the image section, or the toner image transferred onto the paper, to be removed from the heat-resistant endless film 52 when the movable member 59 is in the position shown by a solid line in the figure.

The cooling fan 53 is disposed in a manner which allows it to blow air against the lower portion of the roller 55 (in the direction of I in the figure).

The roller 58 is located between the heat roller 50 and the roller 55 in the loop of the film 52.

The controller 61 can control the movable member 59, as mentioned later, so that the position of the movable member 59 is changed in accordance with the intended glossiness of a copy, namely, the movable member 59 is controlled to be in the position shown by a solid line in the figure when a highly glossy copy is intended (e.g., for full-color copying) and in the position shown by a pointed chain line in the figure when a less glossy copy is required (e.g., for black and white reproduction).

The roller 55 is so constructed as to be urged by the tension spring 54 with the roller 50 as a fulcrum in the direction of II in the figure when the movable member 59 is in the position shown by a solid line shown in FIG. 8 and with the roller 58 as a fulcrum in the direction of III in the figure when the movable member 59 is in the position shown by a pointed chain line in the figure.

The operation of the fixing device shown in FIG. 8 is described below.

When a highly glossy copy is desired or full-color reproduction is intended by means of a fixing device, the controller 61 controls the movable member 59 to be in the position shown by a solid line in FIG. 8 for the following operation. The transfer paper having a color toner image is fed through the heat rollers 50 and 51, during which the color toner image transferred from the original is heated by the heat rollers 50 and 51 so that the toner image on the transfer paper is welded onto the heat-resistant endless film 52, carried along the guide 57, and then getting out from the heat-resistant endless film at the roller 55 position after the toner section of the transfer paper is removed.

When sent out, the transfer paper can be cooled by the wind blown from the cooling fan 53 at the roller 55 position.

The color toners are usually made of polyester, epoxy, or other resin with a relatively low melting temperature (around 110°-95° C.), the amount of the toners attached onto the paper is some 3 mg/cm$^2$ at most.

Using the toners thus prepared and the heat-resistant endless film 52 made of heat-resistant polyimide resin and coated with fluorocarbon resin with a surface energy of 30 dyne/cm under the conditions of the heat-resistant endless film 52 rotation speed v being 170-100 mm/sec and the fixing temperature being 190°-170° C., an electrophotographic copying apparatus of the above-mentioned construction was tested experimentally, resulting in a very glossy and vivid full-color reproduction.

Specifically, the glossmeter reading indicates the surface glossiness of 40-60% substantially improved from 20-30% obtained in full-color copying under the same conditions as above except for a large quantity of oil applied on the surface of the heat roller 50.

Using toner with a low melting temperature, therefore, a glossy and vivid copy can be obtained while preventing the occurrence of an offset phenomenon even if no oil is applied on the surface of the heat roller.

In addition, air cooling by the cooling fan 53 brings more effective removal of the transfer paper from the heat-resistant endless film 52.

Next, in case of black and white reproduction, toner for such reproduction is made of styrene-acrylic, polyester, epoxy, or other resin with a normal melting temperature (around 140°-120° C.) and attached onto the paper by 1 mg/cm$^2$ at most.

Using the toner thus prepared and the heat-resistant endless film 52 made of heat-resistant polyimide resin and coated with fluorocarbon resin with a surface energy of 30 dyne/cm under the same conditions of the heat-resistant endless film 52 rotation speed v being 170-100 mm/sec and the fixing temperature being 190°-170° C., black and white reproduction with the fixing device arranged as shown by a solid line in FIG. 2 was tested experimentally, resulting in the surface glossiness of 40% which is a too high value in view of the legibility of black and white reproduction.

Then, allowing the controller 61 to drive the movable member 59 along the guide 60 so that the roller 55 on which the heat-resistant endless film 52 is applied is urged by the tension spring 54 with the roller 58 as a fulcrum in the direction of increasing the distance from the heat rollers 50 and 51 and the guide 57 (in the direction of III in the figure) and the fixing device is so configured as to remove the toner image of the transfer paper from the heat-resistant endless film 52 at the roller 58 position (as shown by a pointed chain line in the figure), black and white reproduction was tested, resulting in the surface glossiness of 5% or less in favor of the excellent legibility of a black and white copy in view of some 3% of surface glossiness obtained from black and white reproduction by an ordinary black and white copier.

A black and white copy with its surface glossiness reduced to some 15% could also be obtained when, with the direction in which the heat-resistant endless film 52 is urged by the tension spring 54 and the roller 55 unchanged, that is, under the same conditions as those for full-color reproduction (urged in the direction of II in the figure), the cooling fan 53 is rendered inoperative.

Using the same fixing device, therefore, a copy different in glossiness can be easily obtained; that is, not only a highly glossy full-color but a less glossy black and white copy is available if the roller 55 on which the heat-resistant film 52 is applied is allowed to be urged by the tension spring 54 with the roller 58 as a fulcrum in a desired direction.

Here, unlike a case exemplified in this embodiment where the construction is such that the surface glossiness of a copy depends upon the position of a roller 58, movable multiple rollers may be disposed so as to control the distance from the heat roller 50 for variable surface glossiness of copied products.

In a preferred embodiment there is provided with a mechanism to control the cooling fan's on-off operation or change the direction in which air is blown against the paper by changing the position of the cooling fan in accordance with the glossiness required on the principle that the surface glossiness is higher when the cooling fan is in operation than when it is out operation.

Furthermore, the roller 45 or 58 may include a cavity capable of containing a cooling material such as liquid nitrogen, with which the toner image transferred onto the transfer paper can be cooled at the roller 45 or 58 part for certainly removal of the transfer paper from the heat-resistant endless film 42 or 52.

Many widely different embodiments of the present invention may be constructed without departing from the spirit and the scope of the present invention. It should be understood that the present invention is not limited to the specific embodiments described in the specification, except as defined in the appended claims.

What is claimed is:

1. An electrophotographic copying apparatus for reproducing a image copy of an original on a transfer material, comprising:

a photosensitive member exposed by light reflected from said original to form an image of said original thereon;

means for developing the image of said original on said photosensitive member with toner to produce a toner image corresponding to the image;

means for transferring said toner image onto said transfer material;

means for fixing said toner image transferred on said transfer material;

means for producing a signal which represents that high surface glossiness of said image copy is required;

means for feeding said transfer material in a path when said signal is produced, said transfer material being fixed fully, and for feeding said transfer material in a part of the path when said signal is not produced.

2. An electrophotographic copying apparatus according to claim 1, wherein said signal producing means is actuated automatically when the original is colored.

3. An electrophotographic copying apparatus according to claim 1, wherein said fixing means include a film member on which the surface of said toner image on said transfer material abuts, a heat roller for driving rotationally said film member, and a heat source contained in said heat roller.

4. An electrophotographic copying apparatus according to claim 3, wherein said feeding means include a first roller disposed at a certain distance from said heat roller and a second roller disposed between said heat roller and said first roller in the way of said film member conveying from said heat roller in a loop of said film member, said film member being stretched between said heat roller and said first roller and being driven to convey by said heat roller, said transfer material being adhered and fed by said film member.

5. An electrophotographic copying apparatus according to claim 4, wherein said path corresponds the distance from said heat roller to said first roller and said part of the path corresponds to the distance from said heat roller to said second roller.

6. An electrophotographic copying apparatus according to claim 5, wherein said apparatus comprises means for shifting a position of said first roller toward a vertical direction against feeding direction of said transfer material so that said film member is bent at said second roller in response to said signal from said producing means.

7. An electrophotographic copying apparatus according to claim 6, wherein said shifting means include a spring connected to said first roller for maintaining tension of said film member, a movable member connected to the other end of said spring, a guide for guiding said movable member, and a controller connected electrically to said movable member for controlling the position of said movable member in said guide in response to said signal from said transmitting means.

8. An electrophotographic copying apparatus according to claim 6, wherein said apparatus further comprises a third roller disposed adjacent to said heat roller outside the loop of said film member for maintaining tension of said film member stretched between said heat roller and said first roller when the position of said first roller is shifted by said shifting means.

9. An electrophotographic copying apparatus according to claim 8, wherein said apparatus further comprises a fourth roller disposed below said film member, a fifth roller disposed below said film member and at a certain distance from said fourth roller, and a conveyor belt stretched between said fourth roller and said fifth roller for feeding said transfer material.

10. An electrophotographic copying apparatus according to claim 6, wherein said apparatus further comprises a guide disposed under said film material for guiding said transfer material.

11. An electrophotographic copying apparatus according to claim 10, wherein said apparatus further comprises a fan disposed under said first roller at said first position.

12. An electrophotographic copying apparatus according to claim 6, wherein said fixing means further include a second heat roller disposed below said first heat roller at a certain distance so that said transfer material with said toner image is pressed between said first heat roller and said second heat roller.

13. An electrophotographic copying apparatus according to claim 6, wherein said signal producing means include means for sensing color of said original.

* * * * *